US008911304B1

(12) United States Patent
Dawson et al.

(10) Patent No.: US 8,911,304 B1
(45) Date of Patent: Dec. 16, 2014

(54) WEIGHTED IRON-TYPE GOLF CLUB HEAD

(71) Applicant: Callaway Golf Company, Carlsbad, CA (US)

(72) Inventors: Patrick Dawson, San Diego, CA (US); Sean Griffin, Carlsbad, CA (US); Brett Carter, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 84 days.

(21) Appl. No.: 13/745,348

(22) Filed: Jan. 18, 2013

Related U.S. Application Data

(60) Provisional application No. 61/701,097, filed on Sep. 14, 2012.

(51) Int. Cl.
*A63B 53/04* (2006.01)

(52) U.S. Cl.
CPC ..... *A63B 53/0475* (2013.01)
USPC ..... 473/350; 473/291

(58) Field of Classification Search
USPC ..... 473/350
See application file for complete search history.

(56) References Cited

U.S. PATENT DOCUMENTS

| | | | | |
|---|---|---|---|---|
| 5,082,278 | A * | 1/1992 | Hsien | 473/242 |
| 6,855,069 | B2 | 2/2005 | Nagai et al. | |
| 7,207,900 | B2 | 4/2007 | Nicolette et al. | |
| 7,976,403 | B2 | 7/2011 | Gilbert et al. | |
| 8,062,150 | B2 | 11/2011 | Gilbert et al. | |
| 8,147,353 | B2 | 4/2012 | Gilbert et al. | |
| 8,157,673 | B2 | 4/2012 | Gilbert et al. | |
| 8,206,837 | B2 | 6/2012 | Gilbert et al. | |
| 2010/0093460 | A1 | 4/2010 | Gilbert et al. | |
| 2011/0086723 | A1 * | 4/2011 | Gilbert et al. | 473/291 |

OTHER PUBLICATIONS

AP2 Advanced Performance to Advance Your Game. [online]. [retrieved on Jan. 16, 2013]. Retrieved from the Internet: <URL: http://www.titleist.com/golf-clubs/irons/AP2.aspx>.

* cited by examiner

*Primary Examiner* — Michael Dennis
(74) *Attorney, Agent, or Firm* — Rebecca Hanovice; Michael A. Catania; Sonia Lari

(57) ABSTRACT

The present invention discloses a forged iron-type golf club head having a cavity, tungsten weighting, and a back cap configured to simulate an undercut, conceal the weighting, and adjust the golf club head's overall weight and center of gravity location without interfering with or affecting the sole configuration. The golf club head of the present invention also includes a J-shaped face thickness pattern to further improve performance.

15 Claims, 3 Drawing Sheets

WEIGHTED IRON-TYPE GOLF CLUB HEAD

The present application claims priority to U.S. Provisional Patent Application No. 61/701,097, filed on Sep. 14, 2012, the disclosure of which is hereby incorporated by reference in its entirety herein.

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to an iron-type golf club head. More specifically, the present invention relates to an iron-type golf club head having a plurality of weights and a back cover to improve forgiveness and refine the club head center of gravity.

2. Description of the Related Art

The prior art discloses various types of weighting for golf club heads, especially iron-type golf club heads. In particular, tungsten alloy, with a density of around 17 g/cc, has been used to add weight to golf club heads for many years. One recent example of this is the Titleist AP2 club, a forged, carbon steel head with two tungsten weights in a lower cavity, a medallion in an upper cavity, and a thin steel sheet metal cover disposed over the lower cavity. See http://www.titleist.com/golf-clubs/irons/AP2.aspx.

This type of weighting is typically included in high-forgiveness golf clubs that are designed for less experienced golfers. Golfers often prefer to use golf clubs that are not obviously designed for less experienced golfers, however, so will opt to play with tour-design clubs, which are traditionally less forgiving. As such, there is a benefit to including features in a golf club head that hide weighting intended to improve forgiveness.

Although the prior art, including the AP2 club, has provided useful methods for providing weighting for iron type golf club heads without revealing the high forgiveness features of the club head, it has not optimized weighting in a way that achieves an ideal combination of forgiveness and golf club head center of gravity (CG) location.

BRIEF SUMMARY OF THE INVENTION

The present invention provides a golf club that is forgiving, optimizes the club head center of gravity location, and has the look of a higher-end tour club by hiding the cavity and weight features.

One aspect of the present invention is an iron-type golf club head comprising a body having a face and a cavity defined by a top portion, a sole portion, a heel portion, and a toe portion, a plurality of high density weights, and a back cap, wherein the high density weights are disposed within the cavity on the sole portion, wherein the back cap is affixed to the sole portion, heel portion, and toe portion to conceal the weights, and wherein the golf club head comprises a J-shaped thickness pattern, which may extend from the face to the sole portion. In some embodiments, the body may be forged from a material such as carbon steel. In some embodiments, the back cap may be composed of a metal material such as stainless steel.

In some embodiments of this invention, each of the plurality of high density weights may be composed of a tungsten alloy. In a further embodiment, the plurality of high density weights may comprise a first tungsten weight, which may be disposed proximate the heel portion, and a second tungsten weight, which may be disposed proximate the toe portion. In another further embodiment, the golf club head may comprise a support beam extending from a rear surface of the face. This support beam may extend from the heel portion to the toe portion, and may divide the cavity into an upper cavity and a lower cavity. In this embodiment, the J-shaped thickness pattern may extend from the face to the support beam, and the back cap may also be affixed to the support beam. Also in this embodiment, the high density weights may disposed within the lower cavity on the sole portion.

In other embodiments of this invention, a lower surface of the back cap may combine with the sole portion to form an overall sole surface of the golf club head, and the lower surface of the back cap may constitute less than 25% of the overall sole surface, or even less than 15% of the overall sole surface.

Another aspect of the present invention is an iron-type golf club head comprising a carbon steel body comprising a face, a perimeter weighting portion, and a cavity delineated by the face and the perimeter weighting portion, first and second weights composed of a tungsten alloy, and a stainless steel back cap, wherein the perimeter weighting portion comprises a sole portion, a heel portion, and a toe portion, wherein the first and second weights are tack welded to an upper surface of the sole portion, wherein the first weight is disposed proximate the heel portion and the second weight is disposed proximate the toe portion, wherein the back cap is welded to the sole portion, and wherein a lower surface of the back cap composes less than 25% of an overall sole surface area. In a further embodiment, the body may be forged, and may further comprise a medallion disposed within the cavity.

In another embodiment, the golf club head may further comprise a support beam extending from a rear surface of the face. This support beam may extend from the heel portion to the toe portion and may divide the cavity into an upper cavity and a lower cavity. In a further embodiment, the golf club head may comprise a J-shaped thickness pattern extending from the face to the support beam. In another further embodiment, the back cap may also be welded to the support beam.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
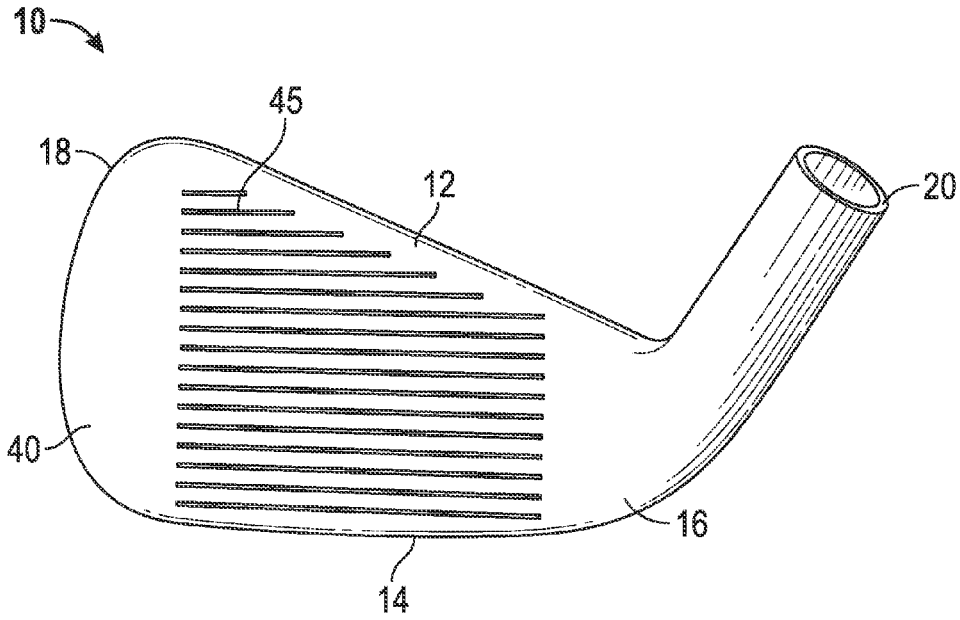
FIG. 1 is a front, perspective view of a first embodiment of the present invention.
Figure 2:
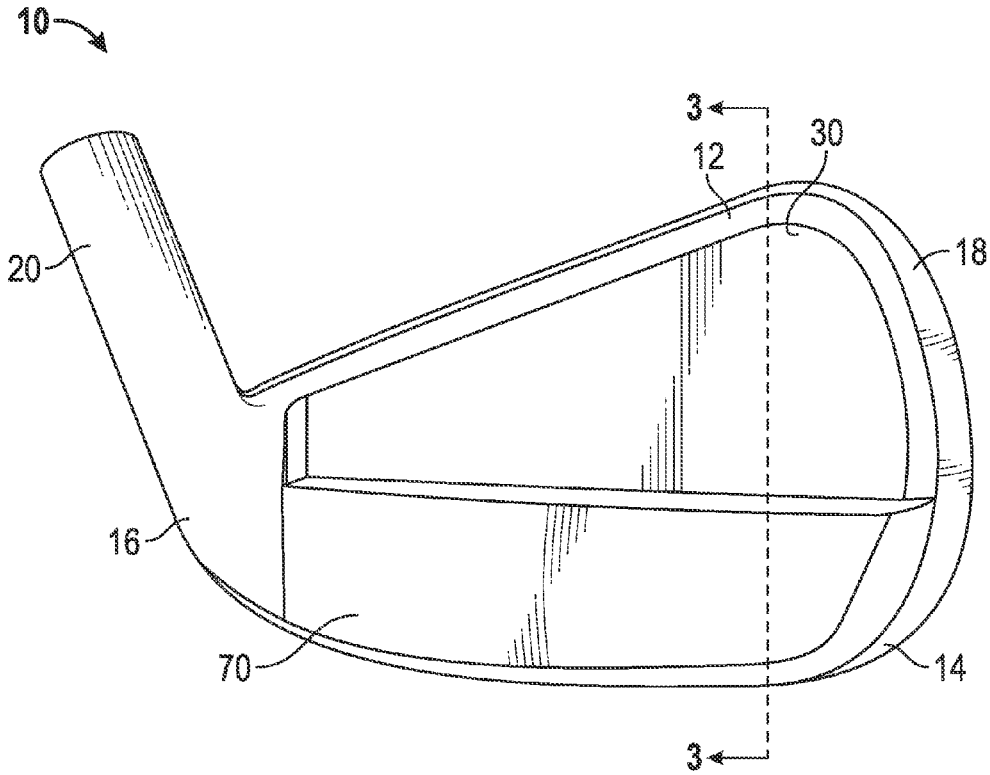
FIG. 2 is a rear, perspective view of the embodiment shown in FIG. 1.
Figure 3:
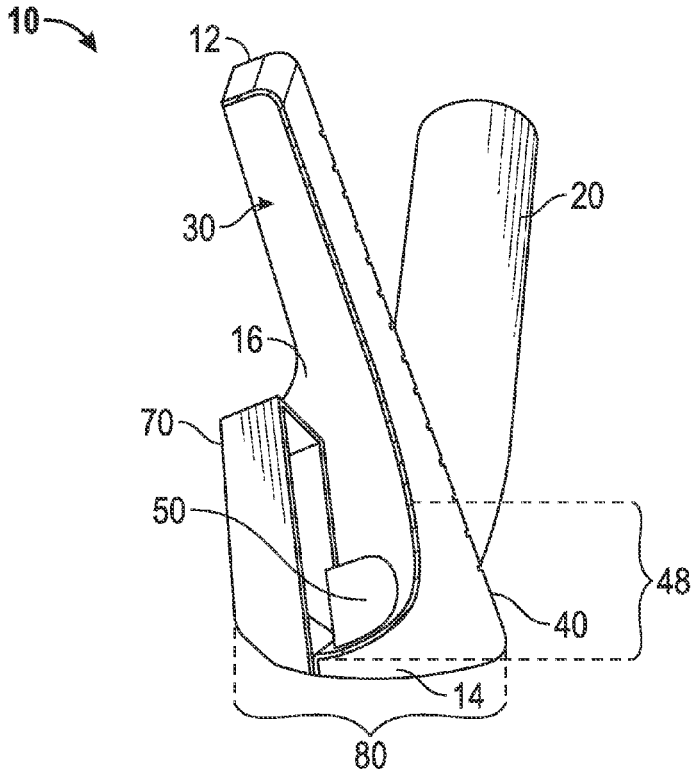
FIG. 3 is a cross-sectional view of the embodiment shown in FIG. 2 along lines 3-3.

A preferred embodiment of the iron-type golf club head 10 of the present invention is shown in FIGS. 1-4. The golf club head 10 has a top portion 12 (also called a top rail), a sole portion 14, a heel portion 16, a toe portion 18, which collectively are also known as a perimeter weighting region, a hosel 20, and a rear cavity 30 encircled by the top portion 12, sole portion 14, and heel and toe portions 16, 18. The golf club head 10 also includes a face 40 with a plurality of grooves 45, which preferably has a J-shaped face thickness pattern 48 as shown in FIG. 3 and described in greater detail in U.S. Provisional Patent Application No. 61/692,822, the disclosure of which is hereby incorporated by reference in its entirety herein, having a gradual thickness transition between the rear side of the face and the sole, such that the corner region has a maximum thickness, which gives the face fewer unsupported regions than the faces of prior art iron-type golf club heads, and preferably an unsupported face area of approximately 2.07 square inches. The golf club head 10 is preferably forged from 1020 carbon steel, though in alternative embodiments it may be composed of titanium alloy, stainless steel, carpenter steel, or amorphous metals and the like, and may be manufactured through other means, such as casting, forming, machining, powdered metal forming, metal-injection-molding, and electro-chemical milling.

Figure 4:
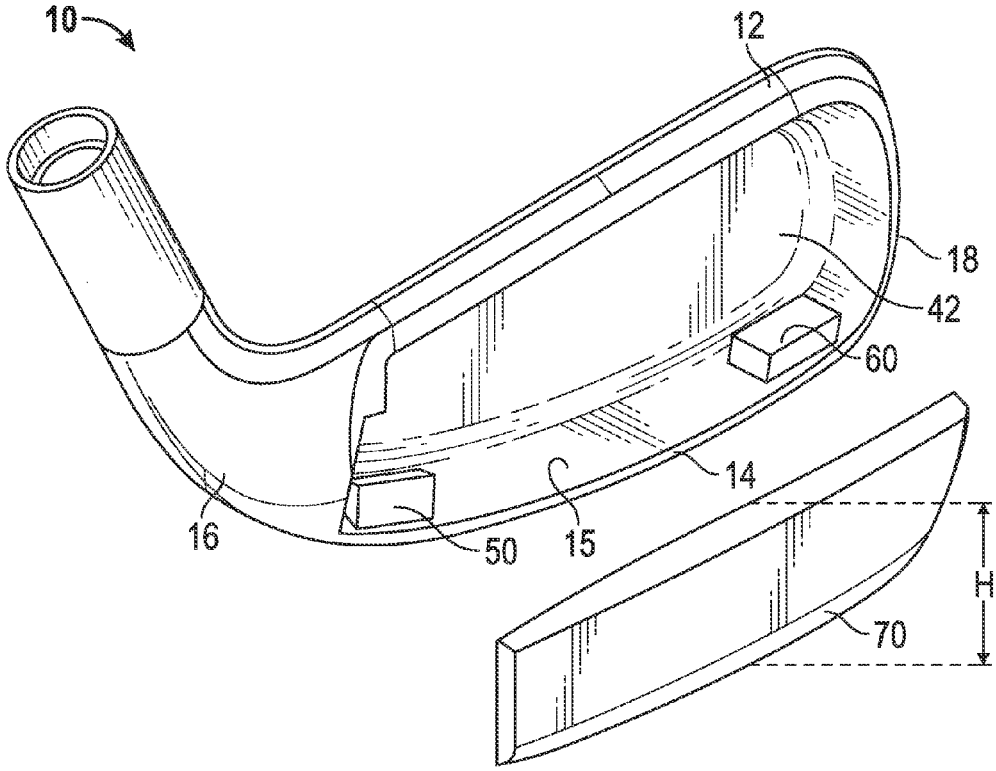
FIG. 4 is a partially exploded, perspective view of the embodiment shown in FIGS. 1-3.

In the preferred embodiment, the golf club head 10 further comprises two high density weights 50, 60, which are preferably composed of a tungsten alloy with a density of approximately 17 g/cc, and are tack welded to an upper surface 15 of the sole portion 14 proximate the rear surface 42 of the face 40. As shown in FIG. 4, one weight 50 is affixed to the upper surface 15 of the sole portion 14 proximate the heel portion 16, while the other weight 60 is affixed to the upper surface 15 of the sole portion 14 proximate the toe portion 18. The locations, shapes, and sizes of these weights 50, 60 on the upper surface of the sole portion 14 can be adjusted during manufacturing to more specifically the golf club head's tailor moment of inertia and center of gravity (CG) location.

After the weights 50, 60 are secured to the sole, a 14 back cap 70 is welded to the sole, heel, and toe portions 14, 16, 18 to act as a rear wall or undercut feature without involving the difficult machining required when adding an undercut to a forged head. The back cap 70 also helps the golf club head 10 appeal to consumers, who prefer that forgiveness features such as the tungsten weights 50, 60 and cavity 30 be hidden because these features are directly associated with forgiving clubs designed for less skilled golfers. The visible part of the cavity 30 can then be filled with a low density resilient material, a decorative medallion, or both.

Figure 5:
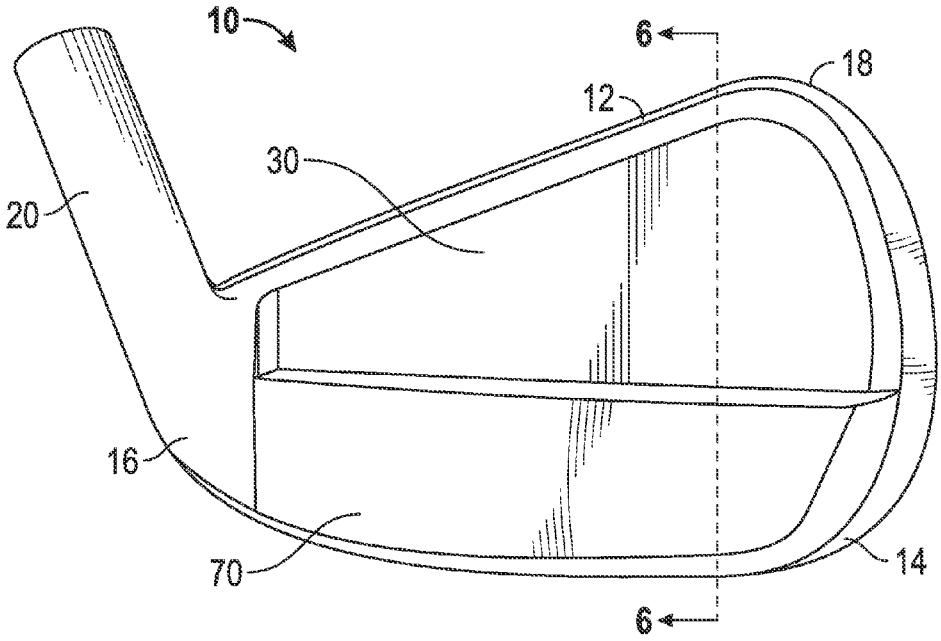
FIG. 5 is a rear, perspective view of a second embodiment of the present invention.
Figure 6:
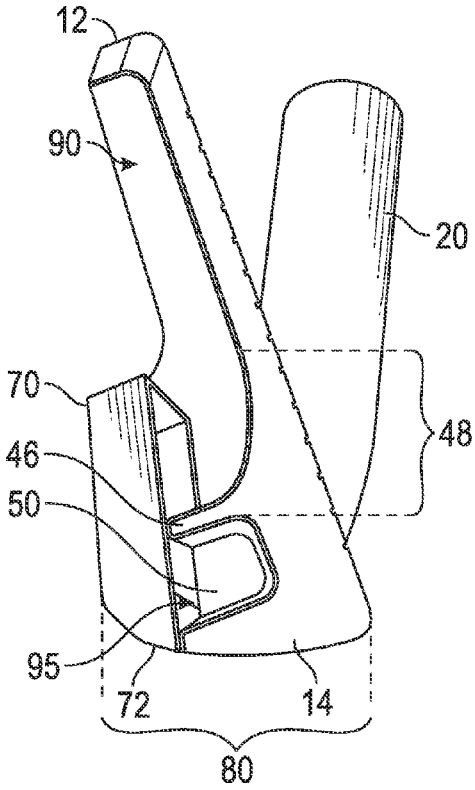
FIG. 6 is a cross-sectional view of the embodiment shown in FIG. 5 along lines 6-6.

An alternative embodiment of the present invention is shown in FIGS. 5 and 6. In this embodiment, the cavity 30 of the golf club head is divided by a support beam 46 extending from the rear surface 42 of the face 40 into an upper cavity 90 and a lower cavity 95. The support beam 46 extends from the heel portion 16 to the toe portion 18 and is configured so that the upper cavity 90 composes about 75% of the entire cavity 30, while the lower cavity composes about 25% of the entire cavity 30. Alternatively, the support beam 46 may be disposed on the rear surface 42 of the face 40 approximately one quarter of the total vertical distance of the cavity above the sole portion 14.

In this embodiment, the weights 50, 60 are tack welded to the sole portion 14 within the lower cavity 95, while in the upper cavity 90, the support beam 46 combines with the face 40 to form the J-shaped face thickness pattern 48 described herein. The back cap 70 is welded to rear surfaces of the sole portion 14, heel portion 16, toe portion 18, and support beam 46 and, as shown in FIG. 6, extends a significant distance above the support beam 46 to conceal the J-shaped face thickness pattern 48 from view. As with the preferred embodiment, the upper cavity 90 may be filled with a low density resilient material, a decorative medallion, or both (not shown).

In each of the embodiments disclosed herein, the back cap 70 preferably is formed from stainless steel, and does not form a significant portion of the overall sole 80 of the golf club head 10. Limiting the sole surface area 72 of the back cap 70 to less than 25% of the overall sole 80, more preferably less than 20% of the overall sole 80, and most preferably less than 15% of the overall sole, reduces the chance that a welding error could affect the sole 80 of the club during manufacture, which is important because the sole 80 on irons determines the club's playability from the variety of conditions a golfer experiences. The back cap 70 also acts as a means to adjust the golf club head's 10 CG, as its height H, weight, and density can be controlled to produce the appropriate CG height target for the targeted consumers.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention the following:

1. An iron-type golf club head comprising: a body having a face and a cavity having a cavity area defined by a top portion, a sole portion, a heel portion, and a toe portion; a plurality of high density weights; a back cap; and a support beam extending from a rear surface of the face from the heel portion to the toe portion, wherein the support beam divides the cavity into an upper cavity and a lower cavity, wherein the upper cavity comprises approximately 75% of the cavity area, wherein the high density weights are disposed within the lower cavity on the sole portion, wherein the back cap is affixed to the sole portion, heel portion, and toe portion to conceal the weights, and wherein the golf club head comprises a J-shaped face thickness pattern; wherein the back cap is affixed to the support beam; wherein a lower surface of the back cap combines with the sole portion to form an overall sole surface of the golf club head, and wherein the lower surface of the back cap constitutes more than 0% and less than 25% of the overall sole surface; and wherein the back cap completely encloses the lower cavity and extends vertically above the support beam to partially enclose the upper cavity.

2. The iron-type golf club head of claim 1 wherein the body is composed of carbon steel.

3. The iron-type golf club head of claim 2, wherein the body is forged.

4. The iron-type golf club head of claim 1, wherein the back cap is composed of a metal material.

5. The iron-type golf club head of claim 4, wherein the back cap is composed of stainless steel.

6. The iron-type golf club head of claim 1, wherein the J-shaped face thickness pattern extends from the face to the sole portion.

7. The iron-type golf club head of claim 1, wherein each of the plurality of high density weights is composed of a tungsten alloy.

8. The iron-type golf club head of claim 1, wherein the plurality of high density weights comprises a first tungsten weight and a second tungsten weight, wherein the first tungsten weight is disposed proximate the heel portion, and wherein the second tungsten weight is disposed proximate the toe portion.

9. The iron-type golf club head of claim 1, wherein the J-shaped face thickness pattern extends from the face to the support beam.

10. The iron-type golf club head of claim 1, wherein the lower surface of the back cap constitutes less than 15% of the overall sole surface.

11. An iron-type golf club head comprising:

a carbon steel body comprising a face, a perimeter weighting portion, and a cavity having a cavity area delineated by the face and the perimeter weighting portion;

first and second weights composed of a tungsten alloy;

a stainless steel back cap; and a support beam extending from a rear surface of the face from the heel portion to the toe portion, wherein the support beam divides the cavity into an upper cavity and a lower cavity, wherein the upper cavity comprises approximately 75% of the cavity area, wherein the perimeter weighting portion comprises a sole portion, a heel portion, and a toe portion, wherein the first and second weights are tack welded to an upper surface of the sole portion, wherein the first weight is disposed proximate the heel portion and the second weight is disposed proximate the toe portion, wherein the back cap is welded to the sole portion, wherein the back cap completely encloses the lower cavity and extends vertically above the support beam to partially enclose the upper cavity, and wherein a lower surface of the back cap composes less than 25% of an overall sole surface area.

12. The iron-type golf club head of claim 11, wherein the body is forged.

13. The iron-type golf club head of claim 11, further comprising a medallion disposed within the cavity.

14. The iron-type golf club head of claim 11, further comprising a J-shaped face thickness pattern extending from the face to the support beam.

15. The iron-type golf club head of claim 11, wherein the back cap is welded to the support beam.

* * * * *